US006150063A

United States Patent [19]

Sugimura et al.

[11] Patent Number: 6,150,063

[45] Date of Patent: Nov. 21, 2000

[54] ELECTROPHOTOGRAPHIC PHOTOCONDUCTOR AND IMAGE FORMATION METHOD

[75] Inventors: Hiroshi Sugimura, Habikino; Yuko Takeda, Tenri, both of Japan

[73] Assignee: Sharp Kabushiki Kaisha, Osaka, Japan

[21] Appl. No.: 09/549,723

[22] Filed: Apr. 14, 2000

[30] Foreign Application Priority Data

May 26, 1999 [JP] Japan ..... 11-146952

[51] Int. Cl.[7] ..... G03G 5/047

[52] U.S. Cl. ..... 430/58.35; 430/59.1; 430/59.5; 430/31

[58] Field of Search ..... 430/58.05, 58.35, 430/59.1, 59.5

[56] References Cited

U.S. PATENT DOCUMENTS

| | | | |
|---|---|---|---|
| 5,294,509 | 3/1994 | Ashiya et al. | 430/58.05 |
| 5,384,625 | 1/1995 | Anayama et al. | 430/59.5 |
| 5,677,094 | 10/1997 | Umeda et al. | 430/58.05 |

FOREIGN PATENT DOCUMENTS

| | | |
|---|---|---|
| 47-18545 | of 1972 | Japan . |
| 56-107247 | 8/1981 | Japan . |
| 59-155851 | 9/1984 | Japan . |
| 61-28557 | 2/1986 | Japan . |
| 61-109056 | 5/1986 | Japan . |
| 1-158456 | 6/1989 | Japan . |
| 5-197167 | 8/1993 | Japan . |
| 6-250421 | 9/1994 | Japan . |
| 7-319179 | 8/1995 | Japan . |
| 10-319613 | 4/1998 | Japan . |
| 11-202511 | 7/1999 | Japan . |

OTHER PUBLICATIONS

Frank H. Moser, et al., Phthalocyanine Compounds, pp. 104–141.

*Primary Examiner*—Roland Martin
*Attorney, Agent, or Firm*—Nixon & Vanderhye, P.C.

[57] ABSTRACT

An electrophotographic photoconductor comprises a charge generation layer containing a phthalocyanine compound as a charge generation material and a charge transfer layer containing a charge transfer material of a hole transfer type, the charge generation layer and the charge transfer layer are laminated on a conductive support, wherein the charge generation layer has an ionization potential of at least 5.6 eV.

8 Claims, 6 Drawing Sheets

ELECTROPHOTOGRAPHIC PHOTOCONDUCTOR AND IMAGE FORMATION METHOD

CROSS-REFERENCE TO RELATED APPLICATION

This application is related to Japanese Patent Application No. HEI 11(1999)-146952 filed on May 26, 1999, whose priority is claimed under 35 USC § 119, the disclosure of which is incorporated by reference in its entirety.

BACKGROUND OF THE INVENTION

1. Field of the Invention

This invention relates to an electrophotographic photoconductor and to an image formation method. More particularly, this invention relates to an electrophotographic photoconductor and an image formation method that are employed in copying machines, printers and the like.

2. Prior Arts

The electrophotographic technology invented by C. F. Carlson provides images having high spontaneousness, high quality and high preservation property. Therefore, this technology has been used widely not only in the field of copying machines but also in the fields of various printers and facsimiles, and has become wide spread. This electrophotographic technology is fundamentally an image formation process that comprises uniform charging of a photoconductor, formation of an electrostatic latent image by image exposure, development of the latent image by a toner, transfer of the toner image to sheets of paper (through an intermediate transfer member in some cases), and fixation.

The material of the photoconductor that constitutes the gist of the electrophotographic technology has shifted in recent years from the conventional inorganic materials such as selenium, arsenic-selenium alloys, cadmium sulfide, zinc oxide, etc, to organic materials because they are pollution-free, can easily form films and can be produced easily.

A laminate type photoconductor, which is produced by laminating a charge generation layer and a charge transfer layer, has become predominant at present and is mass-produced because it has a higher sensitivity, has a wide selection range of materials, has high safety and high productivity by coating or the like, and is relatively advantageous from the aspect of the production cost.

Means capable of digitally forming the images have been limited in the past to laser printers and LED printers, as output machines of word processors and personal computers, and a part of color laser copying machines. Recently, however, the digital image formation technology has made a rapid progress in the field of ordinary copying machines in which analog image formation has been predominant, so as to acquire the image having higher image quality, to store the input image and to execute free edition of the image.

Performance required for the photoconductor to be employed for such digital image formation is mainly as follows.

(1) The photoconductor has sensitivity to light of a long wavelength.

(2) A dark potential must be kept always constant.

(3) Interference between incident light and reflected light must be prevented.

In other words, (1) when computer information is directly handled, electric signals of the information are converted to optical signals and are then inputted to the photoconductor. When the information is inputted from an original manuscript, the information is read as optical information, is then converted to a digital electric signal, is again converted to an optical signal and is thereafter inputted to the photoconductor. In either case, the digital signal is inputted as the optical signal to the photoconductor. A laser beam or an LED beam has been mainly used for such an optical input. The oscillation wavelength of the optical input that has gained the widest application at present is near infrared-rays of 780 nm or light of a long wavelength of 650 nm. Therefore, the photoconductor used for the digital image formation must be sensitive to such light of a long wavelength.

A wide variety of materials have been examined so far to constitute such a photoconductor. Among them, phthalocyanine compounds can be synthesized relatively easily and most of them are sensitive to light of a long wavelength. Therefore, they have been examined widely and put into practical application. For example, Japanese Patent No. 2,073,696 discloses a photoconductor using titanyl phthalocyanine, Japanese Patent Laid-Open No. SHO59-155851 discloses a photoconductor using β type indium phthalocyanine, Japanese Patent Publication No. SHO56-17657 discloses a photoconductor using X type non-metallic phthalocyanine, and Japanese Patent Laid-Open No. SHO61-28557 discloses a photoconductor using vanadyl phthalocyanine.

(2) When digital image formation is carried out, a so-called "inversion development system" which causes a toner to adhere to a portion to which light are irradiated and forms the image is employed in many cases so as to utilize effectively light and to improve resolution. In this inversion development system, a non-exposed portion (dark potential) becomes a white base and an exposed portion (bright potential) becomes a black base (image line). Unlike a normal development system, the inversion development system is free from the occurrence of a so-called "photographic fog" (the occurrence of black spots on the white base) even when the bright potential rises. When the dark potential drops, however, the fog occurs. Therefore, the photoconductor used for the digital image formation must keep the dark potential always constant. A Scorotron charger is ordinarily used as a charger.

(3) Laser is used to write digitally the image onto the photoconductor. Such a coherent ray of light is likely to invite interference. The incident light and the reflected light from a conductive support interfere with one another in the photoconductor, generating a bright and dark fringe pattern (moire) on the image. Therefore, the interference between the incident light and the reflected light must be prevented. Japanese Patent No. 1,929,859, for example, proposes to coarsen the support surface, and Japanese Patent No. 1,932,365 proposes to sandwich an opaque intermediate layer.

Digital copying machines, in general, create an intermediate tone by modulating pulse width. More concretely, they produce the laser output by ON/OFF two values, divide one dot of the oscillation time into 256, for example, and generate gradation by changing the output in 256 stages from 256/256 as the maximum output to 1/256 as the minimum output. When this ratio (that is referred to as "duty") is small, exposure energy is low and a high potential is held. When the ratio is greater, on the other hand, exposure energy is great and the potential drops to a low level, giving contrast of the potential.

The photoconductor using the phthalocyanine compound that satisfies these three requirements as the charge generation material has high sensitivity to light of a long wavelength. As a result, the potential drops greatly to light having a low duty and small exposure energy, but the potential does not drop sufficiently to light having a high duty and large exposure energy. Therefore, the contrast on the low potential side cannot be acquired sufficiently.

This phenomenon results from the following fact. The ionization potential of the charge generation layers using phthalocyanine, in general, is smaller than the ionization potential of the charge transfer layer, that is, about 5.2 to about 5.6 eV. The difference of their ionization potentials functions as a barrier to the injection of holes from the charge generation layer to the charge transfer layer. This phenomenon becomes remarkable particularly when the potential of a photosensitive layer is low and the potential gradient is small. In this case, it becomes difficult to secure the potential contrast.

The ionization potential of titanyl phthalocyanine (oxytitanium phthalocyanine) varies depending on the crystal condition, and is within the range of 5.2 to 5.4 eV. It is 5.2 to 5.3 eV (in Japanese Patent Laid-Open No. SHO6-250421), 5.22 eV (in Japanese Patent Laid-Open No. HEI7-319179) and 5.35 V (in Japanese Patent Laid-Open No. HEI10-319613).

As to injection of the holes from the charge generation layer to the charge transfer layer, no injection barrier exists and the injection of the holes can be done more smoothly if the ionization potential of the charge generation layer is greater than that of the charge transfer layer. However, since the ionization potential of titanyl phthalocyanine used conventionally is small, the injection of the holes into the charge transfer layer cannot be made smoothly. In consequence, the charge that cannot be injected remains in the charge generation layer on the lower potential side and the potential does not drop sufficiently. Therefore, the contrast of the potential cannot be made great, a beautiful intermediate tone cannot be obtained.

In view of the background described above, titanyl phthalocyanine having a large ionization potential has been desired so that the injection of the holes can be made smoothly from the charge generation layer to the charge transfer layer.

SUMMARY OF THE INVENTION

The present invention provides an electrophotograhic photoconductor which comprises a charge generation layer containing a phthalocyanine compound as a charge generation material and a charge transfer layer containing a charge transfer material of a hole transfer type, the charge generation layer and the charge transfer layer are laminated on a conductive support, wherein the charge generation layer has an ionization potential of at least 5.6 eV.

Further, the present invention provide a method of forming an image comprising the step of forming a half tone electrostatic latent image on the electrophotographic photoconductor comprising a charge generation layer containing a phthalocyanine compound as a charge generation material and a charge transfer layer containing a charge transfer material of a hole transfer type that are laminated on a conductive support, the charge generation layer has an ionization potential of at least 5.6 eV, by using an area gradation method using optical inputs of digital signals.

BREIF DESCRIPTION OF THE DRAWINGS

DESCRIPTION OF THE PREFERRED EMBODIMENTS

The electrophotographic photoconductor according to the present invention has basically the construction in which a charge generation layer containing a charge generation material and a charge transfer layer containing a charge transfer material are laminated on a conductive support. An intermediate layer may be sandwiched between the conductive support and the charge generation layer.

Figure 1:
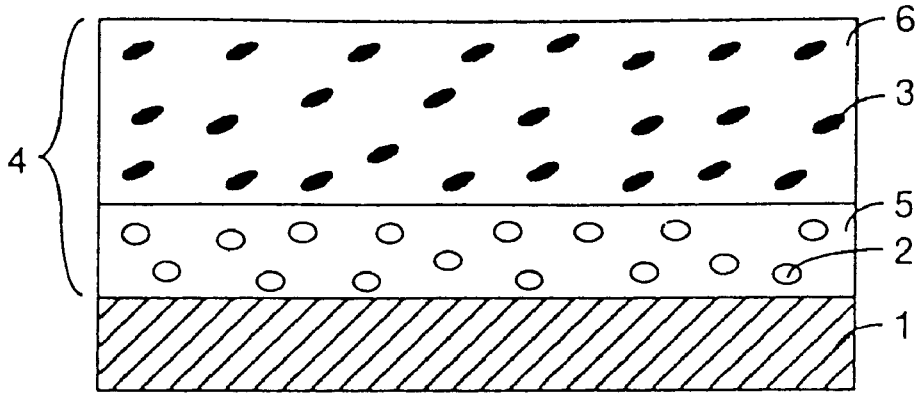
FIG. 1 is a schematic sectional view of principal portions of an electrophotographic photoconductor according to the present invention, and is useful for explaining its construction.
Figure 2:
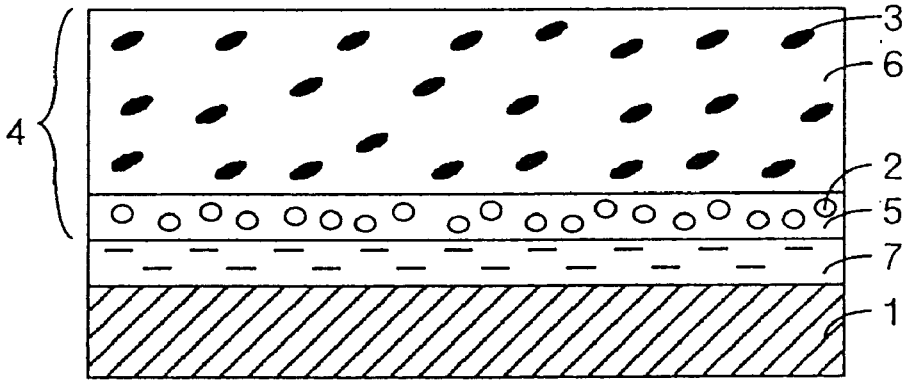
FIG. 2 is a schematic sectional view of principal portions of another electrophotographic photoconductor according to the present invention, and is useful for explaining its construction.

As shown in FIG. 1, a charge generation layer 5 is formed by dispersing a charge generation material 2 into a binder resin, and a charge transfer layer 6 is formed by dispersing a charge transfer material 3 into a binder resin. The charge transfer layer 6 is laminated on the charge generation layer 5 to form a photosensitive layer 4. The photosensitive layer 4 is in turn laminated on a conductive support 1 to form an electrophotographic photoconductor. Alternatively, an intermediate layer 7 is sandwiched between the conductive support 1 and the charge generation layer 5 as shown in FIG. 2 to give a similar electrophotographic photoconductor made of photosensitive layer 4 having a laminate structure. Incidentally, the charge transfer layer may be formed on the charge generation layer, or vice versa, in the electrophotographic photoconductor according to the present invention.

The conductive support in the electrophotographic photoconductor according to the present invention is not particularly limited so long as it is the one that is ordinarily used as the conductive support of this kind. The support may be made of a material having conductivity by itself. Examples of such a material include aluminum, aluminum alloys, iron, gold, silver, copper, zinc, stainless steel, nickel and titanium. Alternatively, plastics or sheets of paper, to which aluminum, gold, silver, copper, zinc, nickel, titanium, indium oxide or tin oxide is deposited, plastics and sheets of paper containing conductive particles, and plastics containing conductive polymers, can be used. The shape of the support may be drum-like, sheet-like and seamless belt-like.

The charge generation layer in the electrophotographic photoconductor of the present invention contains a phthalocyanine compound as the charge generation material, has an ionization potential of at least about 5.6 eV and has a sensitivity to the wavelength band of the laser beam. Examples of the phthalocyanine compound are non-metallic phthalocyanine compounds and phthalocyanine compounds in which metals such as copper, indium, gallium, tin, titanium, zinc, vanadium, etc, or their oxides or chlorides, are coordinated. These phthalocyanine compounds may be used either alone or in mixture of two or more compounds. Preferred particularly among them is a oxytitanium phthalocyanine because it has high sensitivity to the rays of a long wavelength band. Various oxytitanium phthalocyanines are available such as an α type, a β type, a Y type and an amorphous type.

Particularly, an oxytitanium phthalocyanine exhibits the principal diffraction peaks at Bragg angles (2θ±0.2°) of 7.3°, 9.4°, 9.6°, 11.6°, 13.3°, 17.9°, 24.1° and 27.2° in the X-ray diffraction spectrum using a Cu-K α rays. Preferred is of the crystal type in which the doublet peak of 9.4° and 9.6° is the greatest diffraction peak and the peak of 27.2° is the second biggest peak. This crystal type oxytitanium phthalocyanine is different from the known crystal type and has excellent properties as the charge generation material having high sensitivity to the light of the long wavelength, particularly to the photosensitive wavelength most suitable for the semiconductor laser and the LED. Since this crystal type oxytitanium phthalocyanine has a stable crystal, it has high crystal stability to solvents and heat, and can be used in a stable way during the production of oxytitanium phthalocyanine itself and the production of the electrophotographic photoconductor. Such an oxytitanium phthalocyanine is expressed, for example, by the following formula:

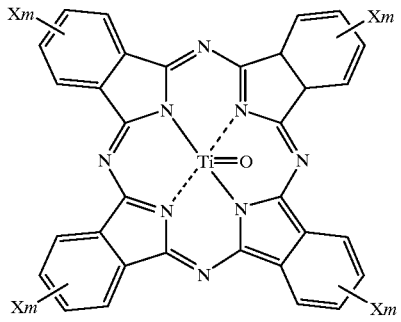

(where X is a halogen atom, an alkyl group or an alkoxy group, and m is an integer of 0 to 4).

The halogen atom includes a fluorine atom, a chlorine atom, a bromine atom and an iodine atom. The alkyl group represents a straight chain or branched chain alkyl group of 1 to 4 carbon atoms. Specific examples are methyl, ethyl, propyl, butyl, iso-propyl and the like. The alkoxy group represents those which have 1 to 4 carbon atoms, and specific examples include methoxy, ethoxy, propoxy, butoxy and the like.

The crystal type oxytitanium phthalocyanine can be synthesized by various known methods such as the method described in Moser and Thomas, "Phthalocyanine Compounds".

For example, o-phthalonitrile and titanium tetrachloride are heated and dissolved, or heated in the presence of an organic solvent such as α-chloronaphthalene to give dichlorotitanium phthalocyanine with high yield. The crystal type oxytitanium phthalocyanine can be obtained by hydrolyzing this dichlorotitanium phthalocyanine with a base or water.

Alternatively, 1,3-diiminoisoindoline and tetrabutoxytitanium are heated with an organic solvent such as N-methyl pyrrolidone to obtain oxytitanium phthalocyanine and the resulting oxytitanium phthalocyanine is treated with an organic solvent not miscible with water such as dichloroethane in the presence of water to give crystal type oxytitanium phthalocyanine. Incidentally, the oxytitanium phthalocyanine obtained as an intermediate product may contain a phthalocyanine derivative in which the hydrogen atom(s) of the benzene ring is substituted by a substitution group such as chlorine, fluorine, nitro group, cyano group or a sulfonyl group.

The methods for treating the oxytitanium phthalocyanine as the intermediate product using the organic solvent not miscible with water in the presence of water is in the following way, for example. First, oxytitanium phthalocyanine is caused to swell by water and is then treated with the organic solvent. Alternatively, water is added to the organic solvent and powder of oxytitanium phthalocyanine is introduced into the solution, without conducting the swelling treatment. However, these methods are illustrative and in no way restrictive.

Examples of the methods of swelling oxytitanium phthalocyanine include a method that dissolves oxytitanium phthalocyanine in sulfuric acid and causes it to precipitate in water to obtain a wet paste, and a method that causes oxytitanium phthalocyanine to swell by water by using agitation/dispersion means such as a homogenizer/mixer, a paint mixer, a ball mill, a sand mill or the like to obtain a wet paste. However, these methods are not restrictive.

Oxytitanium phthalocyanine can be prepared also by stirring or milling by mechanical strain force the oxytitanium phthalocyanine that is obtained by hydrolysis or a composition containing the same, for a sufficient time in a solution of a solvent or a solvent dissolving therein a binder resin. Besides the ordinary stirring machines, it is possible to employ a homogenizer/mixer, a paint mixer, a disperser, an agitator, a ball mill, a sand mill, a paint shaker, a dyno-mill, an attritor, a ultrasonic disperser, etc, as the apparatus used for this treatment.

After the treatment, the product may be filtrated and washed with methanol, ethanol or water, for isolation. Alternatively, a binder resin may be added to the product so as to use the product as a coating solution. If the binder resin is added in advance at the time of treatment, the product may be used as such.

In the present invention, the charge generation layer may contain other charge generation materials besides the phthalocyanine compound. Examples of such other charge generation materials are an azo pigment, an anthraquinone pigment, a perylene pigment, a polycyclic quinone pigment, a squalium pigment and the like. The amount of the charge generation material contained in the charge generation layer is from about 0.5 to about 50 wt % on the basis of the total weight of the charge generation layer, and preferably from about 1 to about 20 wt %.

The charge generation layer of the present invention can be formed by depositing the charge generation material to the conductive substrate using a vapor phase deposition method such as vacuum deposition, sputtering, or a liquid phase deposition method such as CVD method.

The charge generation material may be dissolved in a suitable solvent optionally together with a binder resin. It may be also pulverized and dispersed by a ball mill, a sand grinder, a paint shaker, a ultrasonic disperser, or the like, and is added to a suitable solvent optionally with the binder resin. The charge generation material prepared in this way is then applied to the conductive support by using a baker applicator, a bar coater, casting, spin coating, or the like, when the conductive support is a sheet, or by a spraying method, a vertical ring method or an immersion coating method when the conductive support is a drum.

The binder resin is not limited, in particular, and any type can be used so long as it is generally used for forming an electrophotographic photoconductor. Examples of the binder resin include vinyl polymers such as polyvinyl chloride, polyvinyl propional, polyvinyl butyral, polyvinyl acetate, polyvinyl acetoacetal, etc; copolymers of the vinyl compounds such as vinyl chloride-vinyl acetate, etc; polyesters; polycarbonates; polyester carbonates; polystyrene; polysulfone; melamine resins; acrylic resins such as polyarylates and polymethyl methacrylate; phenoxy resins; cellulose type resins such as cellulose esters and cellulose ethers; urethane resins; and silicone resins and epoxy resins. These resins may be used either alone or in mixture of two or more resins. Copolymers of the monomers that constitute these resins, and partially cross-linked thermosetting resins, may be used, too. When the charge generation layer contains the binder resin, the proportion of the binder resin to the charge generation material is generally 100 parts by weight of the binder resin to 10 to 500 parts by weight, preferably 50 to 300 parts by weight, of the charge generation material.

Examples of the solvent are ketones such as acetone, methyl ethyl ketone, methyl isobutyl ketone, cyclohexanone, etc; esters such as ethyl acetate and butyl acetate; ethers such as tetrahydrofuran and dioxane; aromatic hydrocarbons such as benzene, toluene and xylene; and non-protonic polar solvents such as N,N-dimethylformamide and dimethyl sulfoxide. These solvents may be used either alone or in mixture of two or more.

The film thickness of the charge generation layer is suitably from 0.05 to 5 $\mu$m and preferably, from 0.08 to 1 $\mu$m.

Besides the charge generation material, the charge generation layer may contain known plasticizers for improving film formability, flexibility, mechanical strength, etc; additives for suppressing the residual potential; dispersing agents for improving dispersion stability; a leveling agent for improving coatability; surfactants; silicone oil and fluorine type oil; anti-oxidants; sensitizers; and other additives.

In the present invention, the ionization potential of the charge generation layer can be adjusted to at least about 5.6 eV, preferably about 5.6 to about 5.8 eV, by selecting appropriate phthalocyanine as the charge generation material and appropriate components contained in the charge generation layer (for example, the resin) and an appropriate method for forming the charge generation layer. In other words, the ionization potential is not merely adjusted by the crystal type of phthalocyanine as the charge generation material, and the selection of the dispersion recipe of phthalocyanine, the resin, and the solvent used for the preparation, is important. Speaking more concretely, the ionization potential within the range described above can be acquired in the following way. First, oxytitanium phthalocyanine having the specific peaks in the X-ray diffraction spectrum, the butyral resin, glass beads having a diameter of about 1 mm and the methyl ethyl ketone solvent are mixed. After these compounds are dispersed for a predetermined time in a paint conditioner, the solvent is added to dilute and disperse the mixture to prepare the charge generation layer coating solution. The conductive support is then immersed into and coated with the charge generation layer coating solution. Although the detailed mechanism has not yet been clarified, the ionization potential is presumably associated with affinity of phthalocyanine with the resin. It has been found out that the ionization potential becomes higher when phthalocyanine has higher affinity with the resin.

The charge transfer layer in the electrophotographic photoconductor in the present invention comprises mainly a hole transfer type charge transfer material, and optionally contains a binder resin.

The charge transfer materials that are generally used for the electrophotographic photoconductor can be used without any limitation, in particular, as the charge transfer material in the present invention so long as they are of the hole transfer type. Examples of the charge transfer material are electron attraction materials such as 2,4,7-trinitrofluorenone and tetracyanoquinodimethane; heterocyclic compounds such as carbazole, indole, imidazole, oxazole, pyrazole, oxadiazole, pyralizone and thiadiazole; aniline derivatives; hydrazone compounds; aromatic amine derivatives; styryl compounds; enamine compounds; benzofuran compounds; and electron donor materials having the group containing these compounds in the main chain or the side chain thereof. These compounds may be used either alone or in mixture of two or more. Among them, the styryl compound, the enamine compound and the benzofuran compound are preferred because they have high stability in the course of repetition of use.

Examples of the styryl compounds are those given by the following formulas:

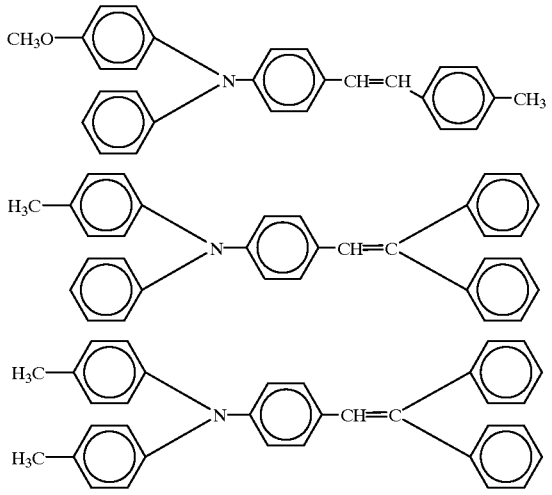

Examples of the enamine compounds are those given by the following formulas:

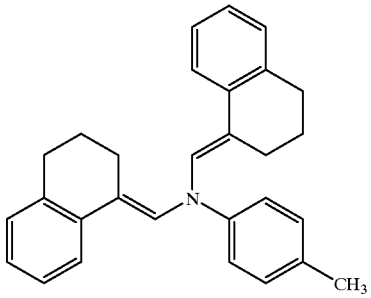

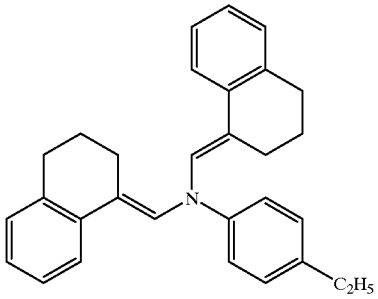

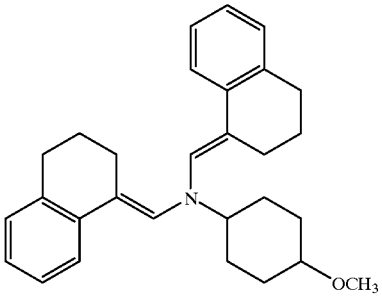

Examples of the benzofuran compounds are those expressed by the formulas given below:

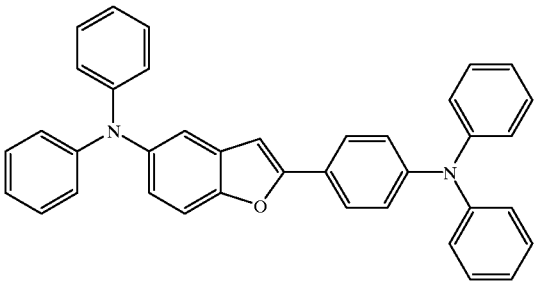

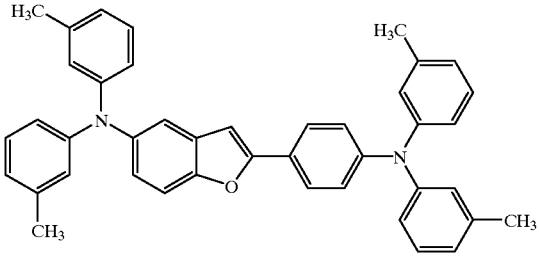

-continued

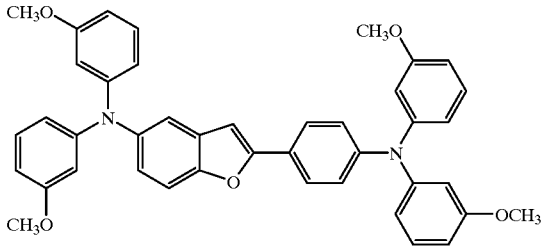

Those binder resins which are ordinarily used for forming the electrophotographic photoconductors can be used in the present invention. Examples of the binder resins include vinyl polymers such as polymethyl methacrylate, polystyrene and polyvinyl chloride, their compolymers, resins such as polycarbonate, polyester, polyester carbonate, polyarylate, polysulfone, polimide, phenoxy, epoxy and silicone. Their partially cross-linked set products can be used, too. These resins can be used either alone or in mixture of a plurality of resins.

The proportion of the binder resin and the charge transfer material is not limited, in particular, so long as it is generally used for forming the electrophotographic photoconductor. The proportion can be selected appropriately in consideration of dispersibility of the charge transfer material and a desired ionization potential. For example, 30 to 200 parts by weight of the charge transfer material are used per 100 parts by weight of the binder resin.

The film thickness of the charge transfer layer is suitably from about 5 to 60 $\mu$m, and is preferably about 10 to 45 $\mu$m.

Incidentally, the charge transfer layer may contain known additives such as plasticizers, anti-oxidants, UV absorbers, leveling agents and the like, to improve film formability, flexibility, coatability and the like.

The charge transfer layer can be formed by, for example, dissolving the charge transfer material in the solvent, adding then the binder resin, and applying the solution using a baker applicator, a bar coater, casting, spin coating, etc, when the conductive support is a sheet, and by a spraying method, a vertical ring method, an immersion coating method, etc, when the conductive support is a drum.

Those solvents which are described above can be used as the solvent in this case, and halogen type solvents such as dichloromethane, 1,2-dichloroethane, etc, can also be used.

The intermediate layer that is sandwiched between the conductive support and the charge generation layer may use an inorganic layer such as an aluminum anodic oxidation film, aluminum oxide, aluminum hydroxide and titanium oxide; and an organic layer such as polyvinyl alcohol, polyvinyl butyral, polyvinyl pyrrolidone, polyacrylic acid, celluloses, gelatin, starch, polyurethane, polyimide, polyamide, casein and N-methoxymethylated nylon. Particles of metals such as aluminum, copper, tin, zinc and titanium, or particles of metal oxides such as titanium oxide, tin oxide and aluminum oxide and particles of conductors or semiconductors, may be dispersed in these inorganic and organic layers.

The film thickness of the intermediate layer is not particularly limited, and is, for example, from about 0.05 to about 20 $\mu$m.

A known over-coat layer such as the one that comprises a thermoplastic or thermosetting resin may be disposed as the outermost layer of the photosensitive layer in the electrophotographic photosensitive layer of the present invention.

Figure 8:
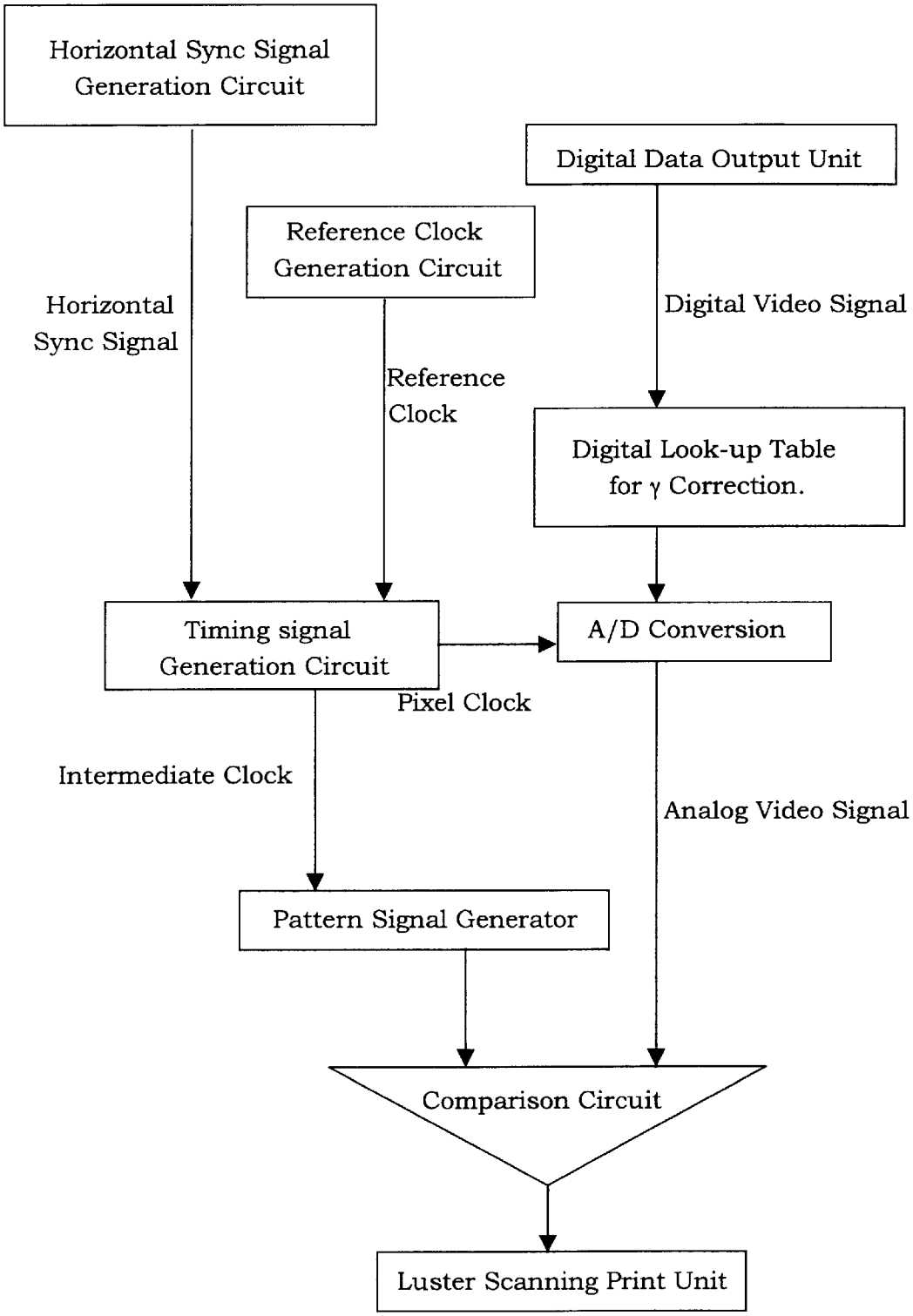
FIG. 8 is a block diagram useful for explaining a method of forming images by using the electrophotographic photoconductor according to the present invention.
Figure 9:
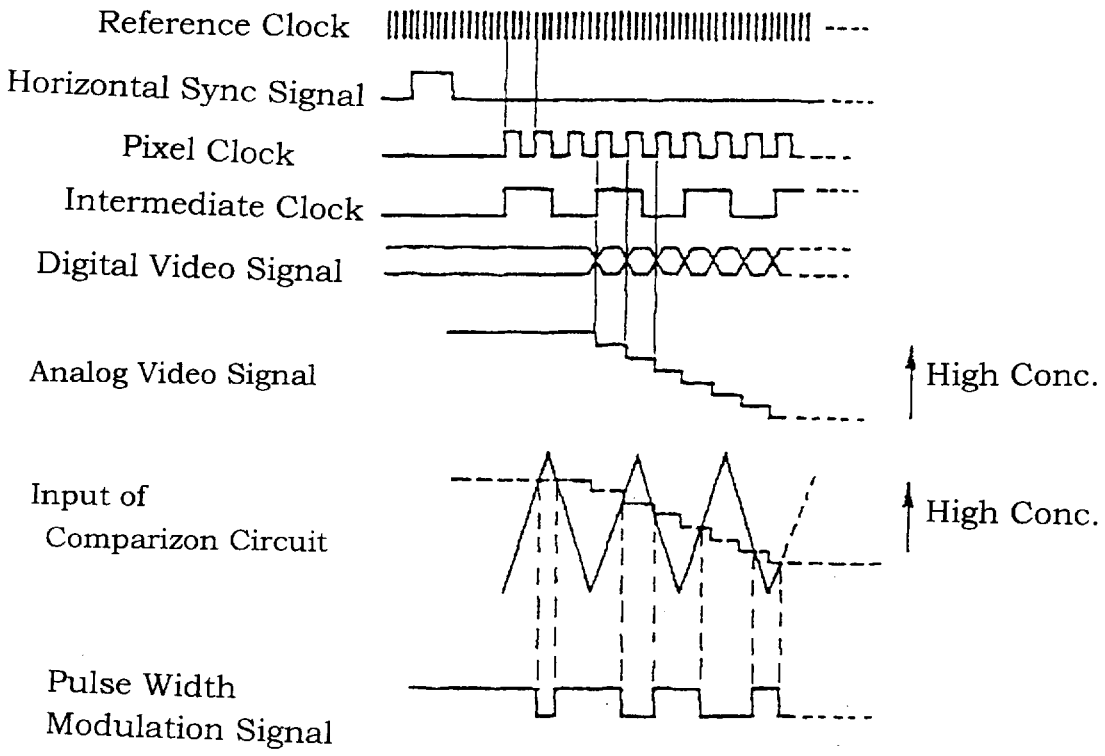
FIG. 9 is a pulse waveform diagram useful for explaining an image formation method using the electrophotographic photoconductor according to the present invention.

The image formation method according to the present invention forms a half tone electrostatic latent image on the electrophotographic photoconductor by using an area gradation method by optical input of digital signals. Image formation can be done by a known method, for example, by the method shown in FIGS. 8 and 9.

A digital data output unit 61 converts analog image data from CCD imaging cells of a scanner unit to digital data (A/D conversion) and outputs a digital video signal of predetermined bits. This signal is used as the address of a digital look-up table 69 for γ correction. The output from this digital look-up table 69 such as an 8-bit output representing 256 gradation levels is converted to an analog signal by a D/A converter 62 for each pixel. Each of the resulting signal of the pixels is serially inputted to one of the terminals of a comparison circuit 64. At the same time, a pattern signal generator 63 generates an analog reference pattern signal of a triangular wave in a cycle that corresponds to a predetermined pitch of the intermediate tone dot, and inputs this signal to the other terminal of the comparison circuit 64.

The reference clock from the reference clock generation circuit 66 counts down to ¼ cycle, for example by a timing signal generation circuit 67 in synchronism with a horizontal synch signal generated by a horizontal sync signal generation circuit 65 for each line. This countdown signal (pixel clock) is used for latching a transfer clock of the digital video signal and the D/A converter 62.

The comparison circuit 64 compares the level of the analog-converted analog video signal with the level of the pattern signal of the triangular wave, and outputs a pulse width modulation signal. This pulse width modulation signal is inputted to a laser modulation circuit of a luster scanning print unit 68 for modulating a 780 nm laser beam. As a result, the laser beam is turned ON and OFF in accordance with the pulse width, and an electrostatic latent image corresponding to an intermediate tone image is formed on the photoconductor of the luster scanning print unit 68.

As described above, a digital image signal is converted to an analog image signal, which is then compared with a signal of a triangular wave of a predetermined frequency. This enables a substantially continuous or linear pulse width modulation and an image output of excellent gradation. This pulse width modulation controls the length of a segment of a scanning line for exposure (that is, an exposed dot on the photo conductor).

Further, a pattern signal synch clock (intermediate tone clock) in synchronism with the horizontal synch signal is formed by use of a reference clock having a higher frequency than that of the pattern signal synch clock for generating a pattern signal (e.g., of a triangular wave). Therefore, jitter of pattern signals generated from the pattern signal generator 63, for example, offset of pattern signals in a first line and a second line, is one-twelfth of the pitch of the pattern signals or smaller in this example. This accuracy is required for ensuring a uniform and smooth formation of a line screen for every line and a high-quality reproduction of intermediate tones.

The horizontal synch signal according to the present invention corresponds to a known beam detect signal since the apparatus is applied to a copying machine using a laser beam.

Examples of the electrophotographic photoconductor and the image formation method of the present invention will be explained in detail. However, the present invention is in no way limited to these Examples within the scope thereof.

Production Example 1

First, 40 g of o-phthalodinitrile, 18 g of titanium tetrachloride and 500 ml of α-chloronaphthalene were reacted by heating and stirring at 220 to 250° C. for 3 hours in a nitrogen atmosphere and then left for cooling. The reaction mixture was then hot filtrated and washed with 200 ml of α-chloronaphthalene heated to 100° C. to give a crude dichlorotitanium phthalocyanine composition.

The crude composition was washed with 200 ml of α-chloronaphthalene and then with 200 ml of methanol, and was thereafter hot suspended and washed in 500 ml of methanol. After filtration, the resulting crude product was stirred and dissolved in 100 ml of concentrated sulfuric acid and the indissoluble components were removed by filtration. The resulting sulfuric acid solution was poured into 300 ml of water to precipitate a crystal. The crystal precipitate was collected by filtration as a wet cake and repeated hot suspension/washing until the pH reached 6 to 7 in 500 ml of water. The wet cake filtrated was treated with dichloromethane and then with methanol and was dried to give an oxytitanium phthalocyanine crystal.

Figure 3:
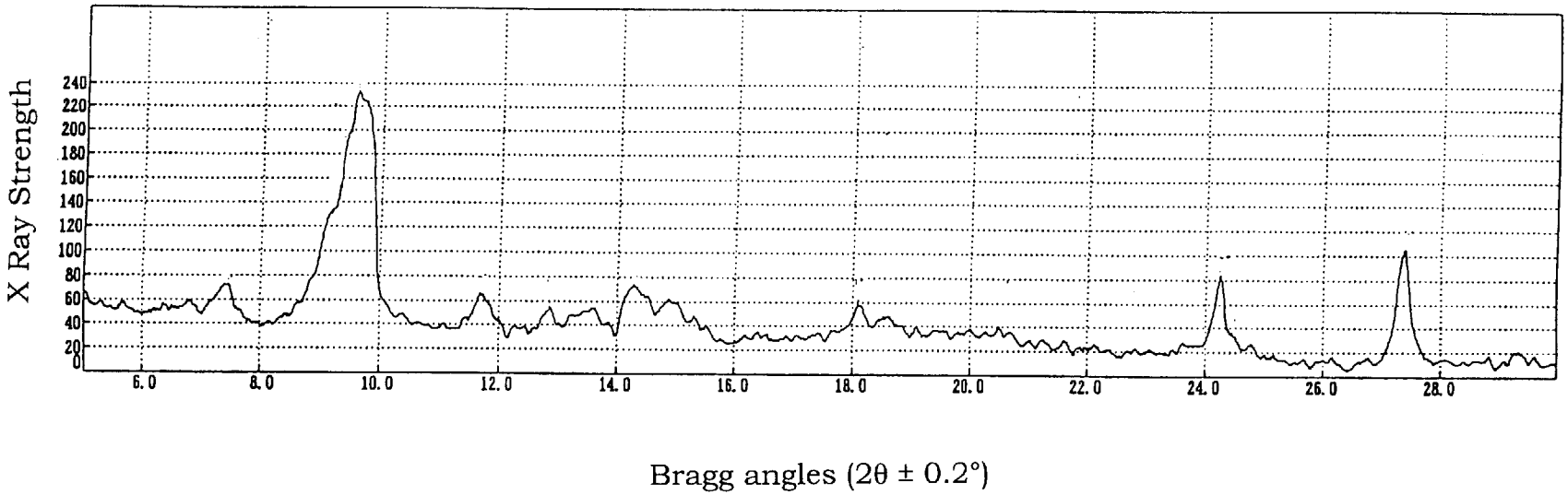
FIG. 3 is a graph showing an X-ray diffraction pattern of oxytitanium phthalocyanine.

The crystal had a structural formula given below, and exhibited the X-ray diffraction spectrum shown in FIG. 3.

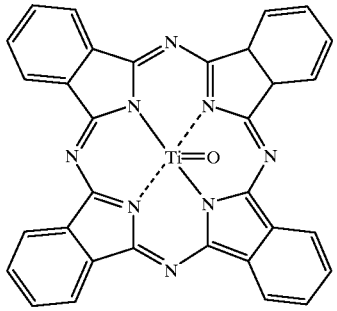

The measurement condition at this time was listed below.

X-ray source: CuKα (wavelength: 1.5418 Å)
Voltage: 30 to 40 kV
Current: 50 mA
Start angle: 5.0°
Stop angle: 30.0°
Step angle: 0.01 to 0.02°
Measurement time: 2.0 to 0.5°
Measurement method: θ/2θ scan method Example 1

First, 71.6 parts by weight of titanium oxide (TT055A, a product of Ishihara Sangyo K. K.) and 107.4 parts by weight of copolymer nylon (CM8000, a product of Toray Co.) were added to a mixed solvent of 287 parts by weight of methyl alcohol and 533 parts by weight of 1,2-dichloroethane. The mixture was dispersed for 8 hours by a paint shaker to prepare a coating solution for forming an intermediate layer. This coating solution was applied to a polyester film to which aluminum was deposited using an applicator, and was dried to form a 1 μm-thick intermediate layer.

Two parts by weight of oxytitanium phthalocyanine obtained by Production Example 1 and 1 part by weight of a butyral resin (BL-1, a product of Sekisui Kagaku K. K.) were mixed with 97 parts by weight of methyl ethyl ketone. The mixture was similarly dispersed by a paint shaker. The resulting coating solution was applied to the intermediate layer and was then dried to give a 0.4 μm-thick charge generation layer.

An ionization potential of this charge generation layer was measured by a surface analyzer AC-1, a product of Riken Keiki K. K. The measurement condition at this time was listed below.

Optical power setting: 50.0 nW

Unit photon: $5\times10^{10}$ cps

Counting time: 10 sec/point

The ionization potential of this charge generation layer was 5.65 eV.

Next, an enamine compound expressed by the formula given below and a polycarbonate resin (PCZ400, a product of Mitsubishi Gas Kakagku K. K.) were mixed on the 1:1 basis. A 15 wt % solution was prepared by using dichloromethane as a solvent, and was applied to the charge generation layer. After drying, there was prepared a 25 μm-thick charge transfer layer.

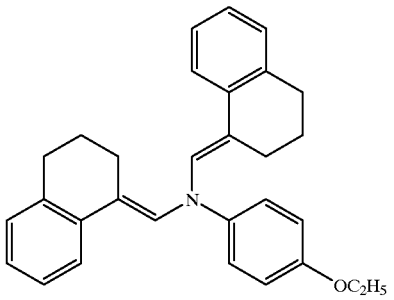

A photoconductor produced in this way was wound on an aluminum cylindrical support having a diameter of 65 mm and a length of 332 mm and was mounted to an experimental machine fabricated by modifying AR5130, a product of Sharp Corp. The surface potential of the photoconductor at the portion of a development tank was measured while the duty of the laser output was varied. The result is shown in FIG. 4.

Figure 4:
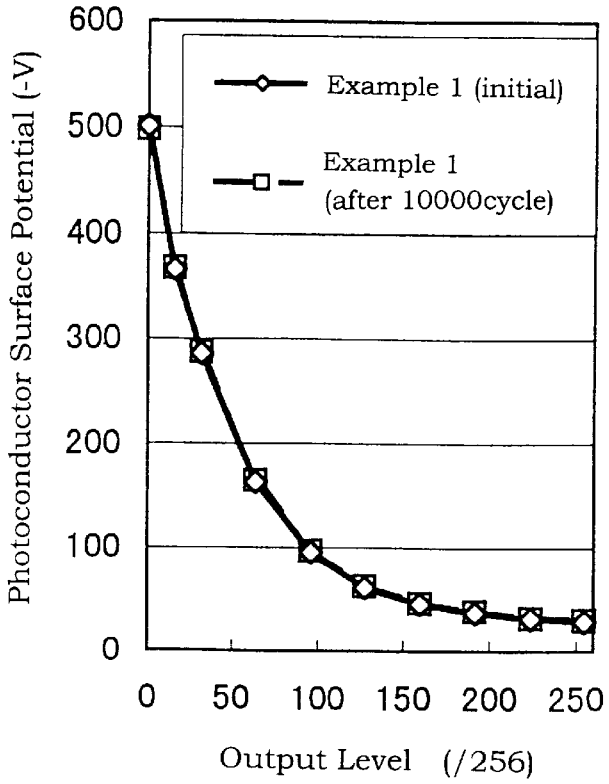
FIG. 4 is a graph showing the relationship between a photoconductor surface potential and an output level in an electrophotographic photoconductor according to the embodiment of the present invention.

It could be appreciated from FIG. 4 that the electrophotographic photoconductor according to Example 1 had excellent gradation till a region having a low potential.

Next, the development tank was mounted and the image was outputted by inversion development. As a result, excellent images could be obtained from a half tone to a black mat.

Furthermore, after the development tank was removed from this experimental machine, and only charge and charge elimination operations were repeated 10,000 times. The sensitivity curve was then measured with the result shown in FIG. 4.

It could be appreciated from FIG. 4 that the electrophotographic photoconductor had excellent property after the repetition of use in the same as in the initial stage.

Example 2

First, an intermediately layer was formed in the same way as in Example 1. Next, 2 parts by weight of oxytitanium phthalocyanine similar to that in Example 1 and 1 part by weight of a butyral resin (BX-1, a product of Sekisui Kagaku K. K.) were mixed with 97 parts by weight of tetrahydrofuran. The mixture was dispersed by using a paint shaker. The resulting coating solution was applied to the intermediate layer and dried to give a 0.4 μm-thick charge generation layer.

When the ionization potential of this charge generation layer was measured, it was 5.63 eV.

A 25 μm-thick charge transfer layer on the charge generation layer in the same way as in Example 1.

The photoconductor obtained in this way was wound on an aluminum cylindrical support having a diameter of 65 mm and a length of 332 mm and was mounted to an experimental machine produced by modifying AR5130, a product of Sharp Corp. The surface potential of the photoconductor at a portion of a development tank was measured while the duty of the laser output was changed.

Figure 5:
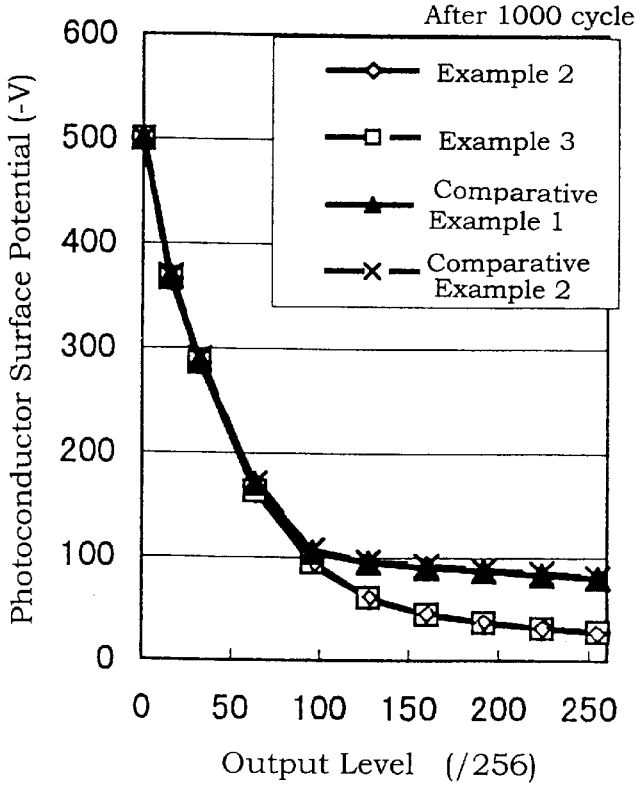
FIG. 5 is a graph showing the relationship between the photoconductor surface potential and the output level in the electrophotographic photoconductor according to each of the embodiments of the present invention and Comparative Examples.

The result is shown in FIG. 5.

It could be appreciated from FIG. 5 that the electrophotographic photoconductor of Example 2 had excellent gradation down to a range having a low potential.

Next, the development tank was mounted, and the image was outputted by inversion development. As a result, excellent images could be obtained from a half tone to a black mat.

Example 3

First, 71.6 parts by weight of titanium oxide (STR60N, a product of Sakai Kagaku K. K.) and 107.4 parts by weight of copolymer nylon (CM8000, a product of Toray Co.) were added to a mixed solvent of 287 parts by weight of methyl alcohol and 533 parts by weight of 1,2-dichloroethane in the same way as in Example 1. The mixed solution was dispersed for 8 hours by using a paint shaker to give a coating solution for forming an intermediate layer. The coating solution was then applied to a polyester film having aluminum evaporated thereto, and was dried to give a 1 μm-thick intermediate layer.

Next, 2 parts by weight of oxytitanium phthalocyanine similar to that in Example 1 and 1 part by weight of a butyral resin (BM-1, a product of Sekisui Kagaku K. K.) were mixed with 70 parts by weight of methyl ethyl ketone. The mixture was similarly dispersed by using a paint shaker. The resulting coating solution was applied to the intermediate layer and was dried to give a 0.4 μm-thick charge generation layer.

When the ionization potential of this charge generation layer was measured, it was 5.61 eV.

A 25 μm-thick charge transfer layer was formed on the charge generation layer in the same way as in Example 1.

The photoconductor was wound on an aluminum cylindrical support having a diameter of 65 mm and a length of 332 mm and was mounted to an experimental machine fabricated by modifying AR5130, a product of Sharp Corp. The surface potential of the photoconductor at a portion of a development tank was measured while the duty of the laser output was varied. The result is shown in FIG. 5.

It could be appreciated from FIG. 5 that the electrophotographic photoconductor of Example 3 had excellent gradation down to a range having a low potential.

Next, the development tank was mounted and the image was outputted by inversion development. As a result, excellent images could be obtained from a half tone to a black mat.

Comparative Example 1

An intermediate layer was formed on a polyester film having aluminum evaporated thereto in the same way as in Example 1.

Next, 2 parts by weight of α type titanyl phthalocyanine and 1 part by weight of a butyral resin (BL-1, a product of Sekisui Kagaku K. K.) were mixed with 97 parts by weight of methyl ethyl ketone. The mixed solution was similarly dispersed by using a paint shaker. The resulting coating solution was applied to an intermediate layer and was dried to give a 0.4 μm-thick charge generation layer.

When the ionization potential of this charge generation layer was measured, it was 5.35 eV.

A 25 μm-thick charge transfer layer was formed on this charge generation layer in the same way as in Example 1.

The photoconductor obtained in this way was evaluated in the same way as in Example 1. The result is shown in FIG. 5.

It could be appreciated from FIG. 5 that the photoconductor exhibited good response in a range where the duty of the laser output was low, but the potential did not drop sufficiently in a range where the duty was high, and gradation was bad.

Next, the development tank was mounted and the image was outputted by inversion development. As a result, though the images had a good half tone, the drop of concentration was observed in a black mat.

Comparative Example 2

A photoconductor was produced in the same way as in Example 1 with the exception that oxytitanium phthalocyanine having a spectrum analogous to the X-ray diffraction spectrum described in Japanese Patent No. 1,950,255 in place of titanyl phthalocyanine produced in Production Example 1.

Ion photoconductor potential of the charge generation layer was 5.44 eV.

The photoconductor obtained in this way was evaluated in the same way as in Example 1. The result is shown in FIG. 5.

It could be appreciated from FIG. 5 that the photoconductor exhibited good response in a range where the duty of the laser output was low, but the potential did not drop sufficiently in a range where the duty was high, and gradation was bad.

Next, the development tank was mounted and the image was outputted by inversion development. As a result, though a half tone of the image was good, the drop of concentration was observed in a black mat.

Example 4

A photoconductor was produced in the same way as in Example 1 with the exception that a styryl compound expressed by the formula given below was used as a charge transfer material in place of the enamine compound used in Example. The photoconductor was evaluated in the same way with the result shown in FIG. 6.

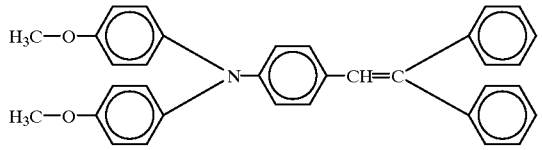

Figure 6:
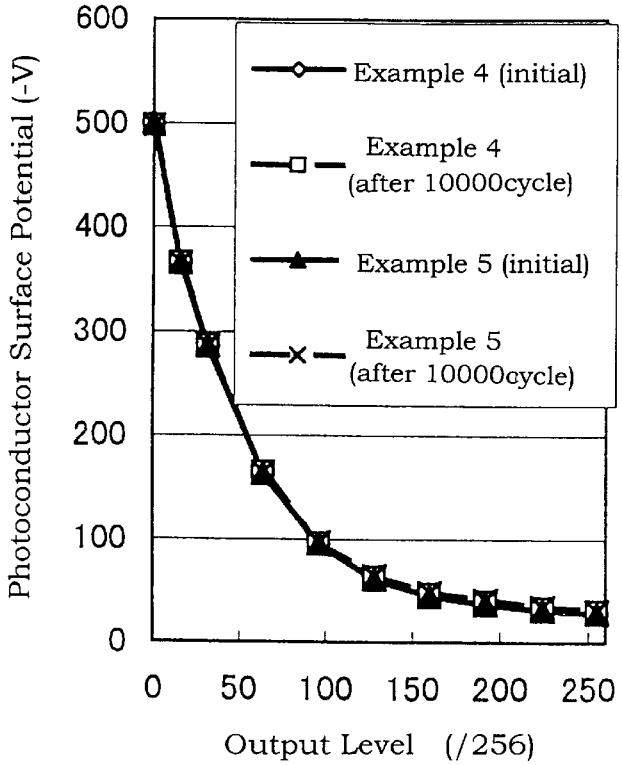
FIG. 6 is a graph showing the relationship between the photoconductor surface potential and the output level in the electrophotographic photoconductor according to the embodiment of the present invention.

It could be appreciated from FIG. 6 that the photoconductor had excellent performance both in the initial stage and after the repetition of use.

Example 5

A photoconductor was produced in the same way as in Example 1 with the exception that a benzofuran compound expressed by the formula given below was used as the charge transfer material in place of the enamine compound used in Example 1. The photoconductor was evaluated in the same way with the result shown in FIG. 6.

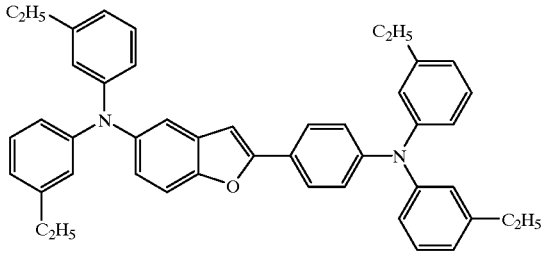

It could be appreciated from FIG. 6 that the photoconductor had excellent performance both in the initial stage and after the repetition of use.

Comparative Example 3

A photoconductor was produced in the same way as in Example 1 with the exception that a hydrazone compound expressed by the formula given below was used as the charge transfer material in place of the enamine compound used in Example 1. The photoconductor was evaluated in the same way with the result shown in FIG. 7.

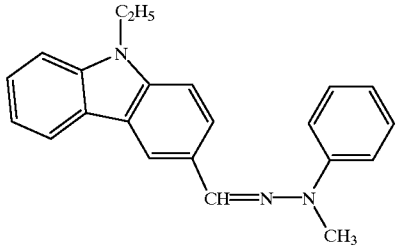

Figure 7:
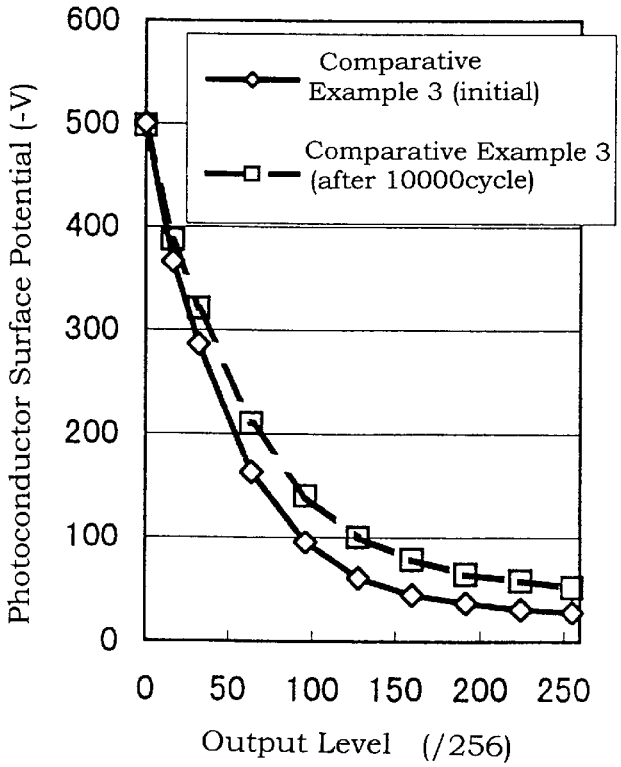
FIG. 7 is a graph showing the relationship between the photoconductor surface potential and the output level in Comparative Example of the electrophotographic photoconductor according to the present invention.

It could be appreciated from FIG. 7 that the electrophotographic photoconductor of Comparative Example 3 had good performance in the initial stage, but the potential did not drop sufficiently in a range where the duty was high after the repetition of use, and gradation got bad.

As described above, the photoconductor according to the present invention comprises the conductive support, and the charge generation layer containing phthalocyanine as the charge generation material and the charge transfer layer containing the hole transfer type charge transfer material that are formed on the conductive support, wherein the charge generation layer has the ionization potential of at least 5.6 eV. Therefore, the present invention can provide an electrophotographic photoconductor in which injection of the charge can be effected smoothly from the charge generation layer to the charge transfer layer even at a low charge. Also, this member is excellent in gradation and is suitable for pulse width modulation used in digital copying machines and printers.

Since the present invention uses the specific charge transfer material, it can provide a photoconductor keeping excellent performance in the repetition of use.

The image formation method using the electrophotographic photoconductor according to the present invention can obtain half tone images having a broad dynamic range from the low concentration to the high concentration.

What is claimed is:

1. An electrophotographic photoconductor comprising a charge generation layer containing a phthalocyanine compound as a charge generation material and a charge transfer layer containing a charge transfer material of a hole transfer type, the charge generation layer and the charge transfer layer are laminated on a conductive support, wherein the charge generation layer has an ionization potential of at least 5.6 eV.

2. An electrophotographic photoconductor according to claim 1, wherein the phthalocyanine compound is an oxytitanium phthalocyanine.

3. An electrophotographic photoconductor according to claim 2, wherein the oxytitanium phthalocyanine is expressed by the formula:

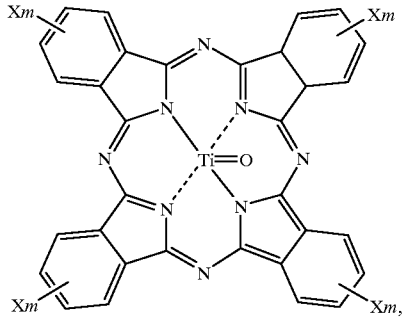

where X is a halogen atom, an alkyl group or an alkoxy group, and m is an integer of 0 to 4.

4. An electrophotographic photoconductor according to claim 2, wherein the oxytitanium phthalocyanine is a crystal type oxytitanium phthalocyanine that exhibits main diffraction peaks at Bragg angles (2θ ±0.2°) of 7.3°, 9.4°, 9.6°, 11.6°, 13.3°, 17.9°, 24.1° and 27.2° in the X-ray diffraction spectrum, the peaks at 9.4° and 9.6° form a doublet peak which is the greatest diffraction peak, and the peak at 27.2° is the second greatest peak.

5. An electrophotographic photoconductor according to claim 1, wherein the charge generation material is contained in a proportion of 0.5 to 50 wt % with respect to the total weight of the charge generation layer.

6. An electrophotographic photoconductor according to claim 1, wherein an intermediate layer is sandwiched between the conductive support and the charge generation layer.

7. An electrophotographic photoconductor according to claim 1, wherein the charge transfer material is selected from the group consisting of a styryl compound, an enamine compound and a benzofuran compound.

8. A method of forming an image comprising the step of forming a half tone electrostatic latent image on an electrophotographic photoconductor including a charge generation layer containing a phthalocyanine compound as a charge generation material and a charge transfer layer containing a charge transfer material of a hole transfer type which are laminated on a conductive support, the charge generation layer having an ionization potential of at least 5.6 eV, by using an area gradation method using optical inputs of digital signals.

* * * * *